US006517444B1

(12) United States Patent
Yoon

(10) Patent No.: US 6,517,444 B1
(45) Date of Patent: Feb. 11, 2003

(54) UPRIGHT GOLF NET ASSEMBLY

(75) Inventor: Young W. Yoon, 127 Michael Manner, Glenview, IL (US) 60025

(73) Assignee: Young W. Yoon, Chicago, IL (US)

( * ) Notice: Subject to any disclaimer, the term of this patent is extended or adjusted under 35 U.S.C. 154(b) by 0 days.

(21) Appl. No.: 09/651,075

(22) Filed: Aug. 30, 2000

(51) Int. Cl.[7] ..... A63B 69/36
(52) U.S. Cl. ..... 473/197; 273/400; 473/476
(58) Field of Search ..... 473/197, 478, 473/476; 273/400, 401, 395, 407

(56) References Cited

U.S. PATENT DOCUMENTS

| | | | | |
|---|---|---|---|---|
| 21,909 A | | 10/1858 | McClellan | |
| 920,907 A | * | 5/1909 | Bolton | 473/197 |
| 1,407,109 A | * | 2/1922 | Winkley | 473/197 |
| 1,430,280 A | * | 9/1922 | Bolton | 473/197 |
| 3,001,795 A | | 9/1961 | Johnson | |
| 3,195,898 A | | 7/1965 | Respini | |
| 3,675,667 A | | 7/1972 | Miller | |
| 3,698,712 A | | 10/1972 | Pero | |
| 3,856,301 A | * | 12/1974 | Davidson | 473/197 |
| 3,960,161 A | | 6/1976 | Norman | |

(List continued on next page.)

FOREIGN PATENT DOCUMENTS

| | | |
|---|---|---|
| FR | 2476494 | 8/1981 |
| FR | 2485379 | 12/1981 |
| JP | 10033738 | 2/1998 |

OTHER PUBLICATIONS

"Brookstone Gift Collection," Jun. 1999.
"The Golfsmith Store," Holiday 1997.
"Hammacher Schlemmer," Summer 1998.
"High Street Emporium," Summer 1998.
"Goldsmith," 1998.
"The Golfsmith Store," Jul. 1999.
"KWIK Goal," 1999 Soccer Equipment.
"Golf Day," Catalog 129C3.
"Excalibur Sunscreen," Excalibur Electronics, Inc.

*Primary Examiner*—Mark S. Graham
(74) *Attorney, Agent, or Firm*—Price, Heneveld, Cooper, DeWitt & Litton

(57) ABSTRACT

An upright golf net assembly for practicing a golf swing has a stored mode collapsible for storage and a deployed mode expandable for practice and includes a pair of interconnected frames. The first and second frames are arranged in a substantially vertical upright position when the assembly is in the deployed mode, each frame having opposite lateral sides and an upper and lower portion. The first and second frames form perimeters that are interconnected at each of their respective opposite lateral sides, such that the first and second frames intersect at their respective opposite lateral sides. The first and second frames are retained in cooperating relation one to the other such that the first and second frames mutually support one another. A netting assembly is attached to the first frame and creates a substantially vertical netting surface for engaging the ball when the assembly is in the deployed mode.

18 Claims, 3 Drawing Sheets

U.S. PATENT DOCUMENTS

| | | | | | |
|---|---|---|---|---|---|
| 3,990,463 | A | | 11/1976 | Norman | |
| 4,029,318 | A | * | 6/1977 | Boss | 273/390 |
| 4,057,252 | A | * | 11/1977 | Pelton | 273/400 |
| 4,063,739 | A | | 12/1977 | La Rose | |
| 4,433,838 | A | * | 2/1984 | Gordon | 273/401 |
| 4,523,760 | A | | 6/1985 | Bednarczuk | |
| 4,825,892 | A | | 5/1989 | Norman | |
| 4,858,634 | A | | 8/1989 | McLeese | |
| 5,088,740 | A | | 2/1992 | Peterson | |
| 5,163,461 | A | | 11/1992 | Ivanovich et al. | |
| 5,249,592 | A | | 10/1993 | Springer et al. | |
| 5,337,772 | A | | 8/1994 | Habchi | |
| 5,421,586 | A | | 6/1995 | Amram et al. | |
| 5,427,381 | A | | 6/1995 | Macaluso et al. | |
| 5,439,017 | A | | 8/1995 | Brown | |
| 5,562,288 | A | * | 10/1996 | Erkebaev | 273/400 |
| 5,569,094 | A | | 10/1996 | Macaluso | |
| RE35,571 | E | | 7/1997 | McLeese | |
| 5,645,096 | A | | 7/1997 | Hazinski et al. | |
| 5,676,168 | A | | 10/1997 | Price | |
| 5,690,339 | A | * | 11/1997 | Chen | 273/400 |
| 5,816,278 | A | | 10/1998 | Kim | |
| 5,842,940 | A | | 12/1998 | Macaluso | |
| 5,863,265 | A | * | 1/1999 | Acton | 473/470 |
| 5,976,023 | A | | 11/1999 | Cho | |
| 5,989,130 | A | | 11/1999 | Macaluso | |
| 6,030,300 | A | * | 2/2000 | Zheng | 473/471 |
| 6,083,124 | A | * | 7/2000 | Williams | 273/400 |
| 6,135,894 | A | | 10/2000 | Cho | |

* cited by examiner

UPRIGHT GOLF NET ASSEMBLY

FIELD OF THE INVENTION

The present invention generally relates to an upright golf net assembly. In particular, the present invention relates to a net assembly formed from first and second closed frames coupled to each other to form a pair of vertically extending, mutually supportive frames to which is attached a netting panel to form a substantially vertical netting surface for engaging a golf ball.

BACKGROUND OF THE INVENTION

Golf remains one of the most popular sports and recreational past times ever. Every year, millions of golfers devote significant time and resources toward improving their golf swings, particularly driving off the tee or fairway. While actually playing a round of golf on a golf course is, of course, the most pleasurable method to develop these skills, playing a round of golf is often difficult and inconvenient and can consume significant time and money. One solution is utilizing so-called driving ranges, where the golfer can repeatedly practice drive or tee shots from a driving station. However, although consuming less time and money than a full round of golf, driving ranges also suffer from the limitations of access and availability to many golfers.

Many solutions to this problem have been proposed. One solution has been the development of frame and net structures that can be used at or near the golfer's home. Such nets may include a circular or square frame forming a periphery to which is attached a mesh or net material. Such frames usually comprise a set of interlocking right-angle poles that, when fully assembled, form a rectangular shape across which is disposed a vertical screen or net and into which a golf ball may be driven. These frames and nets of the prior art are, however, usually fairly expensive and complex to assemble, particularly when assembled alone. Also, the loss of even a single pole segment renders the entire net useless. Such nets further typically consume significant storage space when not in use.

Other frames comprise self-erecting flexible loops that can be folded upon themselves and which are attached about their periphery to a net or mesh. Although easier to deploy, such frames likewise tend to consume significant space and are typically smaller when deployed and hence of lower utility. Thus, golf practice nets that expand to a larger target area are desired. Also, it is desired that the golf net positively catch the ball and allow the same to drop in front of the net for ready retrieval.

SUMMARY OF THE INVENTION

To overcome these and other disadvantages of the prior art, the present disclosure, briefly described, provides an upright golf net assembly for practicing a golf swing. The assembly has a stored mode collapsible for storage and a deployed mode expandable for practice and includes a pair of interconnecting frame. The first and second frames are arranged in a substantially vertical upright position and each form a perimeter when the assembly is in the deployed mode, each perimeter having opposite lateral sides, and an upper and lower portion. The first and second frames are interconnected at each of their respective opposite lateral sides of their first and second perimeters, such that the first and second frames intersect at their respective opposite lateral sides. The first and second frames are retained in cooperating relation one to the other such that the first and second frames mutually support one another. When deployed, the upper portion of the first frame is disposed in front of the upper portion of the second frame and the lower portion of the first frame is disposed behind the lower portion of the second frame. A netting assembly is attached to the first frame and creates a substantially vertical netting surface for engaging the ball when the assembly is in the deployed mode. The netting assembly, so configured, is slightly forwardly inclined when the assembly is in the deployed mode. Accordingly, the ball is positively caught and allowed to drop in front of the net for ready retrieval.

Preferably, the first and second frames comprise a pair of a closed, elongated collapsible loops coupled one to the other. Further, the first and second frames are preferably encased in circumferential webbing, with the webbing of the second loop fixedly attached to the webbing of the first loop at opposite lateral sides of the periphery of the first loop.

The golf net assembly of the present invention can be readily deployed and collapsed, while providing a large-sized net that is very effective for use in practicing golf swings.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto.

In this respect, before explaining the preferred embodiment of the disclosure in detail, it is to be understood that the disclosure is not limited in its application to the details of the construction and the arrangements set forth in the following description or illustrated in the drawings. The golf net assembly of the present disclosure is capable of other embodiments and of being practiced and carried out in various ways. Also, it is to be understood that the phraseology and terminology employed herein are for description and not limitation. Where specific dimensional and material specifications have been included or omitted from the specification or the claims, or both, it is to be understood that the same are not to be incorporated into the appended claims.

As such, those skilled in the art will appreciate that the conception, upon which this disclosure is based, may readily be used as a basis for designing other structures, methods, and systems for carrying out the several purposes of the present invention. It is important, therefore, that the claims are regarded as including such equivalent constructions as far as they do not depart from the spirit and scope of the present invention.

Further, the purpose of the Abstract is to enable the U.S. Patent and Trademark Office and the public generally, and especially the scientists, engineers and practitioners in the art who are not familiar with the patent or legal terms of phraseology, to learn quickly from a cursory inspection the nature and essence of the technical disclosure of the application. Accordingly, the Abstract is intended to define neither the invention nor the application, which is only measured by the claims, nor is it intended to be limiting as to the scope of the invention in any way.

The fundamental aspects of the invention, along with the various features and structures that characterize the invention, are pointed out with particularity in the claims annexed to and forming a part of this disclosure. For a better understanding of the golf net assembly of the present disclosure, its advantages and the specific objects attained by its uses, reference should be had to the accompanying drawings and descriptive matter in which there are illustrated preferred embodiments of the invention.

While embodiments of the golf net assembly are herein illustrated and described, it is to be appreciated that various changes, rearrangements and modifications may be made therein, without departing from the scope of the invention as defined by the appended claims.

BRIEF DESCRIPTION OF THE FIGURES

The disclosure of the golf net assembly is explained with illustrative embodiments shown in the accompanying drawing, where.

DETAILED DESCRIPTION OF THE PREFERRED EMBODIMENT

Figure 1:
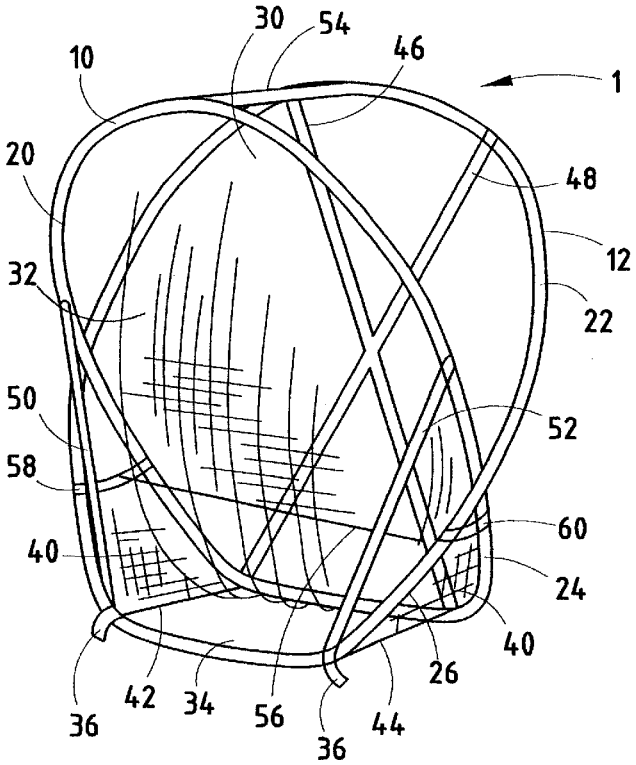
FIG. 1 is a perspective overall view of a first preferred embodiment of the present invention.

The best mode for carrying out the invention is presented in terms of the preferred embodiment, wherein similar reference characters designate corresponding features throughout the several figures of the drawings.

Referring now to the drawings, particularly FIG. 1, there is shown in perspective view the upright golf net assembly of the present invention. The upright golf net assembly 1 consists primarily of a first frame 10 and a second frame 12, each forming an outer perimeter and each being interconnected one to the other at the respective opposite lateral sides of the perimeters of each of the first and second frames 10 and 12, respectively.

Figure 2:
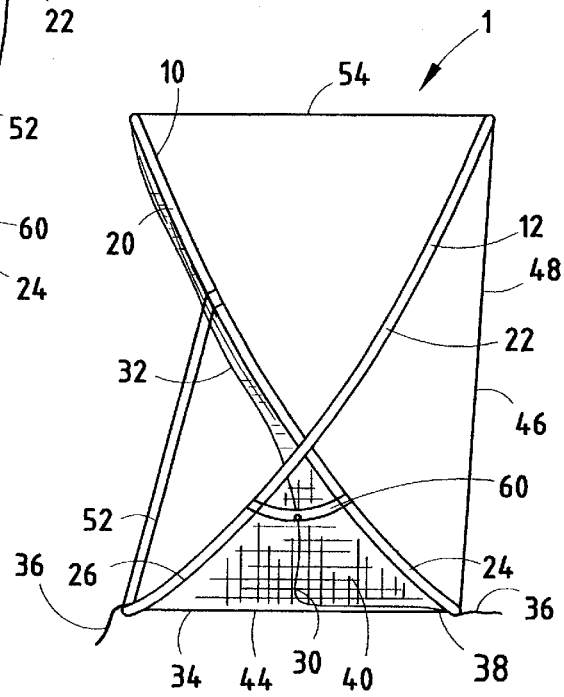
FIG. 2 is a side view of the first preferred embodiment of the present invention.
Figure 3:
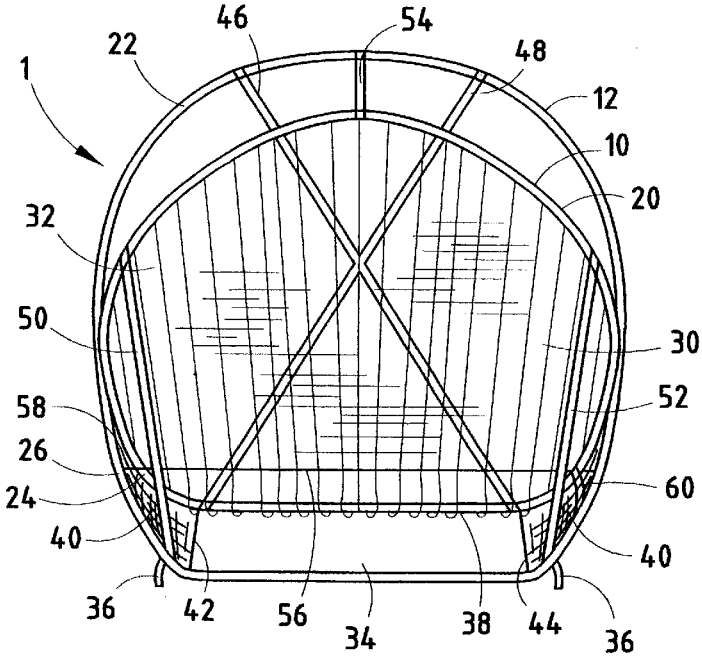
FIG. 3 is a frontal perspective overall view of the first preferred embodiment of the present invention.

The assembly 1 has a stored mode (not shown) collapsible for storage and a deployed mode, as shown, expandable for practice. As shown in FIGS. 1–3, the first frame 10 and the second frame 12 are preferably constructed of closed, elongated collapsible loops. Each of the frames 10, 12 thus has a memory urging them to a circle. When a user desires to deploy the assembly 1, all that is necessary is that the user simply release the frames 10 and 12 from bindings that hold the frames 10, 12 in their stored mode and the assembly 1 will essentially deploy itself. The frames 10 and 12 are simply uncoiled and allowed to unfold until their webbing straps, discussed below, restrict further movement, and the assembly 1 assumes the shape shown in the Figures.

To store the assembly, it is only necessary to refold the frames 10 and 12 into a final compacted circle structure of four turns representing a diameter of approximately one quarter of the erected frame diameter. To reduce the assembly 1 from the deployed assembly 1, the lateral sides of each of the first and second frames 10 and 12 are brought toward one another. The structure will then twist naturally into a "Figure 8" shape. Once together, the "Figure 8" shape is then folded to form four coincident circles. Preferably, the resulting diameter is 4 feet inches or less. Restraints may be placed about this compacted structure to hold it in compacted shape as desired. Deploying the assembly 1 is simply the reverse.

Figure 4:
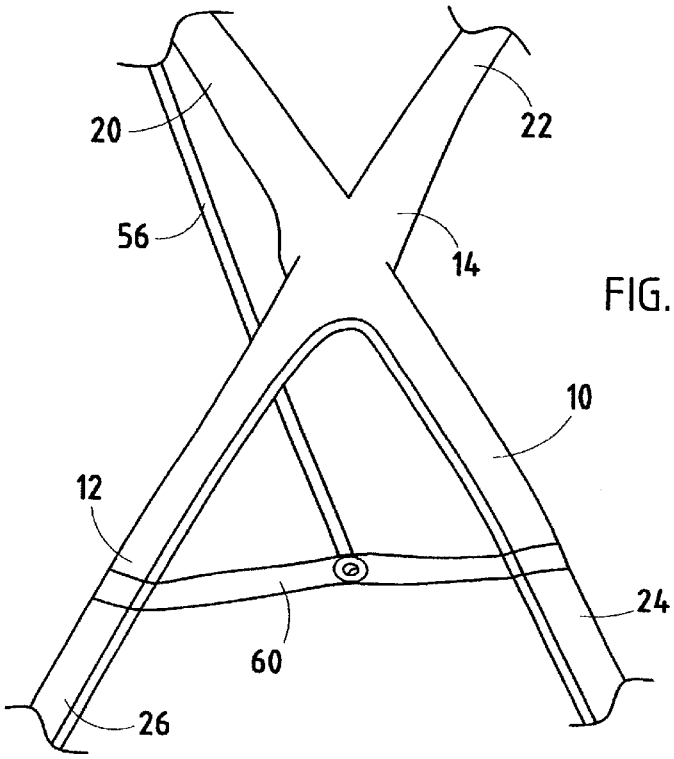
FIG. 4 is a partial view of the intersection of the lateral sides of the first and second frames of the first preferred embodiment of the present invention.

While steel frames may be used, frames fabricated from fiberglass of about 0.25 inch in diameter are preferred. Each of the frames 10 and 12, respectively, is also preferably encased in nylon webbing 14 throughout, as best shown in FIG. 4, whereby the frames are interconnected by sewing the nylon webbing 14 of the first frame 10 to the nylon webbing of the second frame 12. The frames 10, 12 are preferably of the same size, which is preferably 6 to 8 feet in diameter.

According to the invention, the first and second frames 10 and 12 are retained in cooperating relation one to the other such that the first and second frames 10 and 12 mutually support one another, as shown in the Figures. When deployed, an upper portion 20 of the first frame 10 is disposed in front of an upper portion 22 of the second frame 12, while a lower portion 24 of the first frame 10 is disposed behind a lower portion 26 of the second frame 12. As the frames 10 and 12 are flexible, the lower portions 24 and 26 of each frame 10 and 12 preferably adapt to and conform to the floor or ground configuration, for example, to form a flat, relatively stable portion, as shown in FIGS. 1–3.

A netting assembly 30 is preferably attached to the perimeter of the first frame 10 to form a substantially vertical netting surface 32 for engaging a ball when the assembly is in the deployed mode. The netting assembly 30 is preferably attached to the first frame 10 by sewing the netting assembly 30 onto the webbing encasing the first frame 10. Thus attached, the netting assembly 30 is further preferably formed of a mesh-type netting fabric made from any natural or synthetic fiber, such as nylon. The mesh preferably has openings of about 0.25 inch. The netting assembly 30, so configured, is slightly forwardly inclined when the assembly 1 is in the deployed mode. Accordingly, any ball that may strike the netting surface is positively caught and allowed to drop in front of the assembly 1 for ready retrieval.

The netting assembly also preferably includes a flexible base panel 34 attached to and extending between the perimeter webbing of the lower portion 24 of the first frame 10 and the lower portion 26 of the second frame 12. The preferred material for the base panel 34 is heavy-duty nylon. As shown in the FIG. 2, the base panel 34 is attached under tension such that the first frame 10 and the second frame 12 form a structure resembling an "X", but with the netting surface 32 nevertheless substantially horizontal. The base panel 34 is also preferably provided with a pair of adjustable nylon webbing straps 36 connected to each side of the assembly 1 for receiving ground stakes in order to further adjust the tension on the base panel 34 and to anchor the assembly 1 to the ground, for example, in windy conditions. Side wings 40 provided in the netting assembly 30 are attached to and extend between the lower portions 24 and 26 of the frames 10 and 12 and are also attached to either side edge 42, 44 of the base panel 34 to form a barrier against the ball rolling away from the assembly 1.

The netting assembly 30 is thus preferably attached to the upper portion 20 of the first frame 10, to rear edge 38 and both side edges 42, 44 of the base panel 34 and to the lower portions 24 and 26 of the first and second frames. The result is substantially a vertical netting surface 32 for engaging a ball when practicing golf strokes. The netting assembly may be loosely attached to the lower portion 24 of the first loop 10, so as to relieve tension from the vertical netting surface 32, as may be desired, to improve the durability of the net assembly. A target (not shown) can be attached to further promote accuracy. After the stroke, the ball hits the substantially vertical netting surface 32 and falls onto the base panel 34 for ready retrieval.

The relationship between the first and second frames 10 and 12 is further preferably maintained by a pair of nylon webbing straps 46, 48 that extend diagonally between opposite sides of the upper portion 22 of the second frame 12 and the lower portion 24 of the first frame 10, such that the straps 46, 48 cross-over one another. A still further set of preferably adjustable nylon webbing straps 50, 52 are preferably located on either side of the assembly 1 and extend midway between the upper portion 20 of the first frame 10 and the lower portion 26 of the second frame 12, as shown in FIG. 1. A nylon webbing strap 54 also preferably extends between the upper portion 20 of the first frame 10 and the upper portion 22 of the second frame 12, as shown. Finally, an adjustable cord 56 preferably extends between straps 58, 60, where the straps 58, 60 in turn are located on either side of the assembly 1 and extend between lower portion 24 of the first frame 10 and the lower portion 26 of the second frame 12 above the ground or floor surface, as best shown in FIG. 4. Each of the straps 58 and 60 are provided with a grommetted opening through which the cord 56 extends. Adjustment of the length of cord 56 is made by adjusting the amount each end of the cord 56 extends on either side through the grommetted opening. The result is that transverse tension between the lateral sides of the first and second frames 10 and 12 can be adjusted to control the width and stability of the net assembly 1.

Figure 5:
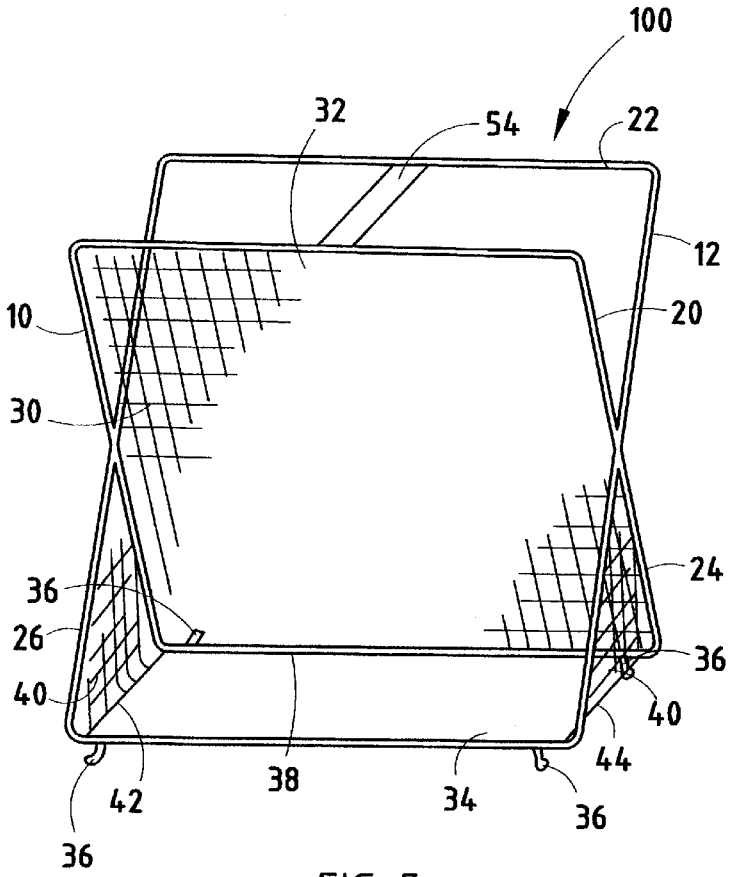
FIG. 5 is a perspective view of the second preferred embodiment of the present invention.

An alternative embodiment is shown in FIG. 5. There, the first and second frames 10 and 12 form a rectangular shape, such as a square as shown. Otherwise, the relationship, features, and structures are the same as described above, in that first and second frames 10 and 12 are retained in cooperating relation one to the other such that the first and second frames 10 and 12 mutually support one another. In the deployed mode, the upper portion 20 of the first frame 10 is again disposed in front of an upper portion 22 of the second frame 12 and the lower portion 24 of the first frame 10 is disposed behind a lower portion 26 of the second frame 12. The flat, relatively stable portion of each of the lower portions 24 and 26 of the frames 10 and 12 supports the assembly 1.

Figure 6:
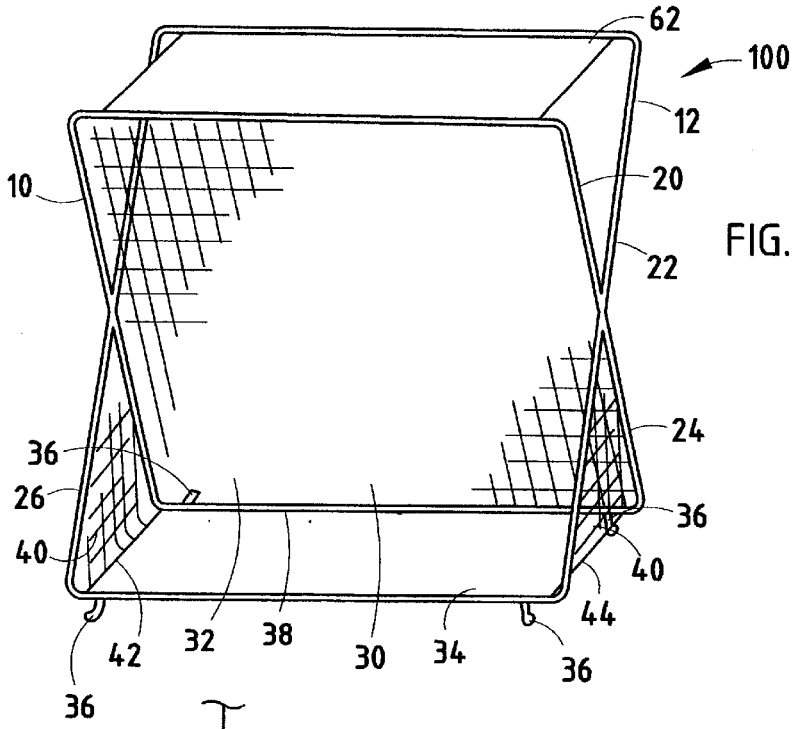
FIG. 6 is a perspective view of the third preferred embodiment of the present invention.
Figure 7:
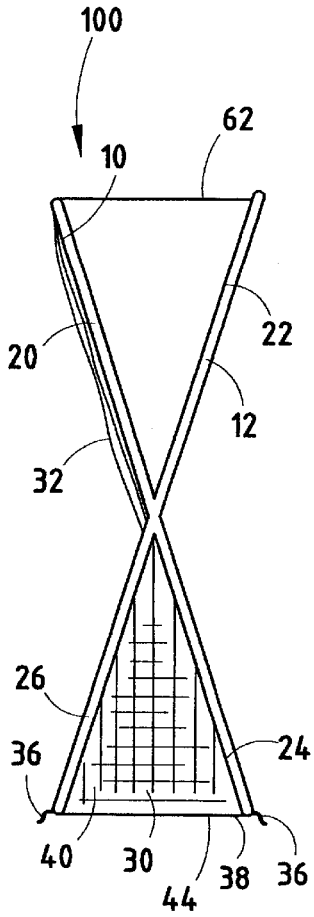
FIG. 7 is a side view of the third preferred embodiment of the present invention.

The frames 10 and 12 are preferably formed of relatively rigid tubular sections joined one to the other at telescoping, intersecting, or interfitting ends, preferably joined together via shock cords, as is known. With the stability created by the flat lower portions 24 and 26 of the frames 10 and 12, the strapping system described above, particularly cord 56 and straps 58, 60, can be omitted if desired. In another preferred embodiment shown in FIGS. 6–7, the upper strap 54 is replaced with an upper panel 62 attached to each of the perimeter webbing of each of the upper portions 20 and 22 of the first and second frames 10 and 12.

Figure 9:
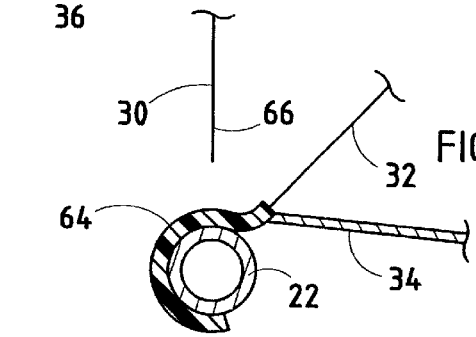
FIG. 9 is a cross-sectional view of the lower portion of the second frame member of the fourth preferred embodiment of the present invention.
Figure 8:
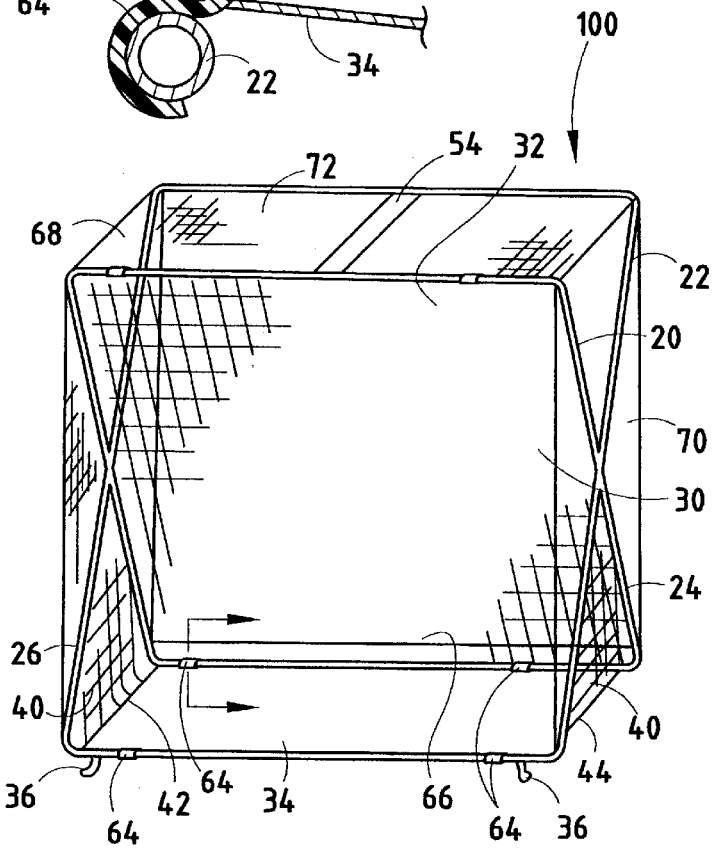
FIG. 8 is a perspective view of the fourth preferred embodiment of the present invention.

A further embodiment is shown in FIG. 8, wherein the netting assembly 30 generally forms a prism having a substantially extending vertical surface 32 extending between the upper portion 20 of the first frame 10 and the lower portion 24 of the second portion, as shown. Preferably, the lower end of the vertical surface 32 intersects with the base panel 34 and is attached to the lower portion 22 of the first frame 10 through clips 64, as shown in FIG. 9. A back panel 66 and side panels 68, 70 extend vertically downwardly and top panel 72 extends between the upper portions 20 and 22 of the frames 10 and 12, respectfully, such when the netting assembly 30 is attached to the tubular frames 10 and 12, the netting assembly 30 substantially encloses the tubular frames 10 and 12, except for the front opening, as shown. The back panel 66 and side panels 68, 70 and top panel 20 can be formed of any lightweight sheeting material, preferably a nylon screening material.

The solutions offered by the invention herein have thus been attained in an economical, practical, and facile manner. While preferred embodiments and example configurations have been shown and described, it is to be understood that various further modifications and additional configurations will be apparent to those skilled in the art. It is intended that the specific embodiments and configurations disclosed are illustrative of the preferred and best modes for practicing the invention, and should not be interpreted as limitations on the scope of the invention as defined by the appended claims and it is to be appreciated that various changes, rearrangements and modifications may be made therein, without departing from the scope of the invention as defined by the appended claims.

What is claimed is:

1. A unitary interconnected upright net assembly having a stored mode that is collapsible for storage and a deployed mode that is self-erecting and expandable for practice, the net assembly comprising:

a first substantially vertical flexible continuous closed-loop collapsible upright frame forming a first perimeter when the assembly is in the deployed mode, the first perimeter having opposite lateral sides, and webbing encasing the first frame, a second substantially vertical upright flexible continuous closed-loop frame forming a second perimeter when the assembly is in the deployed mode, the second perimeter having opposite lateral sides and webbing encasing the second frame, wherein webbing of the first and second frames are interconnected at each respective opposite lateral sides of the first and second perimeters of the frames such that the first and second frames intersect at their respective opposite lateral sides and are permanently retained in cooperating relation one to the other such that the first and second frames mutually support one another, a netting assembly attached to the webbing of one of the first and second frames about the perimeter thereof to form a substantially vertical netting surface when the assembly is in the deployed mode, and a base panel extending between and interconnecting the first and second frames and retaining the first and second frame in cooperating relation one to the other when in the deployed mode.

2. The upright net assembly of claim 1, wherein the first and second frames comprise a pair of closed, elongated collapsible loops coupled one to the other.

3. The upright net assembly of claim 1, wherein the first and second frames comprise a pair of closed, rectangular loops coupled one to the other.

4. The upright net assembly of claim 1, wherein the base panel is comprised of nylon and is attached to the circumferential webbing of the first and second frames.

5. The upright net assembly of claim 1, further comprising a top connector, wherein the top connector extends between the first and second frames and retains the first and second frame in cooperating relation one to the other.

6. The upright net assembly of claim 5, wherein the distance the top connector extends between the first and second frame is adjustable.

7. The upright net assembly of claim 5, wherein the top connector is a fabric panel.

8. The upright net assembly of claim 1, wherein each of the first and second frames have upper and lower portions, such that the upper portion of the first frame is disposed in front of the upper portion of the second frame and the lower portion of the first frame is disposed behind the lower portion of the second frame, the netting assembly attached to the first frame such that the netting assembly is slightly forwardly inclined when the assembly is in the deployed mode.

9. A unitary interconnected upright net assembly for practicing a golf swing for hitting a golf ball, wherein said assembly has a stored mode collapsible for storage and a self-erecting deployed mode expandable for practice, the net assembly comprising a pair of interconnecting continuous flexible closed-loop collapsible frames:

a first of said pair of frames in a substantially vertical upright position and forming a first perimeter when the assembly is in the deployed mode, the first perimeter having opposite lateral sides and a top, and webbing encasing the first frame.

a second of said pair of frames in a substantially vertical upright position and forming a second perimeter when the assembly is in the deployed mode, the second perimeter having opposite lateral sides, and webbing encasing the second frame, wherein the webbing of the first and second frames are interconnected at each respective opposite lateral sides of the first and second perimeters, such that the first and second frames intersect at their respective opposite lateral sides and are permanently retained in cooperating relation one to the other such that the first and second frames mutually support one another, each of the first and second frames having upper and lower portions, the upper portion of the first frame disposed in front of the upper portion of the second frame and the lower portion of the first frame disposed behind the lower portion of the second frame, and a netting assembly attached to and about the webbing of the first perimeter of said first frame to form a substantially vertical netting surface when the assembly is in the deployed mode, the netting assembly being slightly forwardly inclined when the assembly is in the deployed mode, and a base panel extending between and interconnecting said first and second frames to maintain said first and second frames in cooperative relation when in the deployed mode.

10. The upright net assembly of claim 9, wherein the first and second frames comprise a pair of a closed, elongated collapsible loops coupled one to the other.

11. The upright net assembly of claim 9, wherein the first and second frames are comprised of a plurality of intersecting tubular members.

12. The upright net assembly of claim 9, wherein the lower portion of each of the first and second frames are substantially horizontal when in contact with a support surface.

13. The upright net assembly of claim 12, wherein the first and second frames each comprise sections joined together to form a rectangular shape.

14. The upright net assembly of claim 9, wherein the netting assembly is further disposed over and about the pair of frames when the assembly is in the deployed mode.

15. A unitary interconnected practice golf net assembly formed from a pair of collapsible closed, elongated loops interconnected one to the other in combination with a netting panel and used for receiving and retaining a golf ball or the like, wherein the golf net assembly is adapted for self-erecting deployment on any relatively flat ground surface and is collapsible for storage and wherein the net assembly comprises:

a pair of interconnecting continuous flexible closed-loop collapsible frames, each frame being encased in webbing about the frame, where a first of said pair of frames is in a substantially vertical upright position and forms a first perimeter when the assembly is in the deployed mode, the first perimeter having a opposite lateral sides and a top, a second of said pair of frames in a substantially vertical upright position and forming a second perimeter when the assembly is in the deployed mode, the second perimeter having a opposite lateral sides, wherein the webbing of the first and second frames are interconnected at each respective opposite lateral sides of the first and second perimeters of the frames, such that the first and second frames intersect at their respective opposite lateral sides and are permanently retained in cooperating relation one to the other such that the first and second frames mutually support one another, each of the first and second frames having upper and lower portions, the upper portion of the first frame disposed in front of the upper portion of the second frame and the lower portion of the first frame disposed behind the lower portion of the second frame, a netting assembly attached to and about the perimeter of the first frame to form a substantially vertical netting surface when the assembly is in the deployed mode, the netting assembly being slightly forwardly inclined when the assembly is in the deployed mode, and a base panel extending from and between and interconnecting the first and second frames when in the deployed mode.

16. The practice golf net assembly of claim 15, wherein the first and second frames are of the same size.

17. The practice golf net assembly of claim 15, wherein the first and second frames are further joined one to the other by adjustable connectors whereby the height and width of the net assembly in the deployed mode may be adjusted.

18. In combination with a golf practice netting panel, a pair of flexible collapsible closed, elongated continuous loops permanently interconnected one to the other to form a pair of substantially vertical adjacent frame members forming a self-erecting X-shaped structure, each frame member encased in webbing and having opposite sides attached one to the other at the webbing such that the frame members intersect each other at a midpoint along each said side of said frame members and a connecting base member extending between and interconnecting said frame members retains the frame members one to the other whereby the frame members mutually support one another, wherein the netting panel forms a substantially vertical surface for engaging a sports item such as a ball or the like when the frame members are deployed on a relatively flat ground surface, wherein the netting panel is attached to a first of the pair of frames.

* * * * *